United States Patent [19]

Hampton et al.

[11] Patent Number: 4,706,054

[45] Date of Patent: Nov. 10, 1987

[54] THERMAL MAGNETIC TRIP UNIT FOR MOLDED CASE CIRCUIT BREAKERS

[75] Inventors: Thomas G. Hampton, Hartford; James M. Mitsch, West Hartford; Joseph M. Palmieri, Southington; David S. Parker, South Windsor, all of Conn.; Donna C. DeRosier, Springfield, Mass.

[73] Assignee: General Electric Company, New York, N.Y.

[21] Appl. No.: 907,332

[22] Filed: Sep. 15, 1986

[51] Int. Cl.[4] ..... H01H 9/00

[52] U.S. Cl. ..... 335/203; 335/38; 335/236

[58] Field of Search ..... 335/35, 37, 38, 124, 335/126, 172, 236, 177, 182, 184, 203

[56] References Cited

U.S. PATENT DOCUMENTS 2,776,349 1/1957 Thomas ..... 335/37
3,421,123 1/1969 Johnson et al. ..... 335/35
4,513,268 4/1985 Seymour et al. ..... 335/35

OTHER PUBLICATIONS

U.S. Patent Application Ser. No. 817,213, filed Jan. 8, 1986, entitled "Interchangeable Mechanism for Molded Case Circuit Breaker", in the names of Ronald D. Ciarcia et al.

*Primary Examiner*—E. A. Goldberg
*Assistant Examiner*—Lincoln Donovan
*Attorney, Agent, or Firm*—Richard A. Menelly; Walter C. Bernkopf; Fred Jacob

[57] ABSTRACT

A magnet piece and armature are arranged around a circuit breaker load strap having a bimetal strip attached thereto. The magnet piece is formed in a U-shaped configuration and is attached to the load strap. A corresponding U-shaped armature is pivotally mounted to the magnet piece in a partially overlapping relation. The U-shape armature presents a larger magnet pole surface to the magnet piece for enhanced magnetic interaction.

20 Claims, 9 Drawing Figures

THERMAL MAGNETIC TRIP UNIT FOR MOLDED CASE CIRCUIT BREAKERS

BACKGROUND OF THE INVENTION

A molded case circuit breaker having a thermal magnetic trip unit wherein the armature in the form of a flat metal plate arranged proximate the upper ends of a U-shaped magnet piece is described in U.S. patent application Ser. No. 817,213, filed Jan. 8, 1986, and entitled "Interchangable Mechanism For Molded Case Circuit Breakers". The U-shaped magnet piece described therein is arranged around a part of the bimetal for magnetic interaction with a movable planar armature when the current through the breaker exceeds a threshold value. The Patent Application is incorporated herein for reference purposes and should be reviewed for a good description of the interaction between the trip unit and the operating mechanism to trip the breaker under predetermined conditions of overload. The bimetal part of the trip unit responds to overcurrent conditions of a first order of magnitude which is allowed to persist for a prescribed period of time before the operating mechanism is articulated to open the contacts. The magnetic trip unit responds to overcurrent conditions such as a short circuit which is several orders of magnitude higher. In some applications, it is desirable to trip the breaker when an overload condition occurs less than short circuit overload conditions in a shorter period of time than that provided by the bimetal. One purpose of the instant invention is to provide a thermal magnetic trip unit wherein the trip thresholds for the magnetic trip unit are reduced by means of an improved magnetic attraction between the armature and the magnet piece therein.

SUMMARY OF THE INVENTION

The invention comprises a thermal magnetic trip unit of the type containing a shaped load strap to which a depending bimetal strip is attached. A U-shaped magnet piece is arranged around the bimetal strip and the corresponding U-shaped armature is movably arranged close to the magnet piece. The U-shaped armature presents a larger area for magnetic interaction with the magnet and, hence, increases the magnetic force of attraction therebetween.

DESCRIPTION OF THE PREFERRED EMBODIMENT

Figure 1:
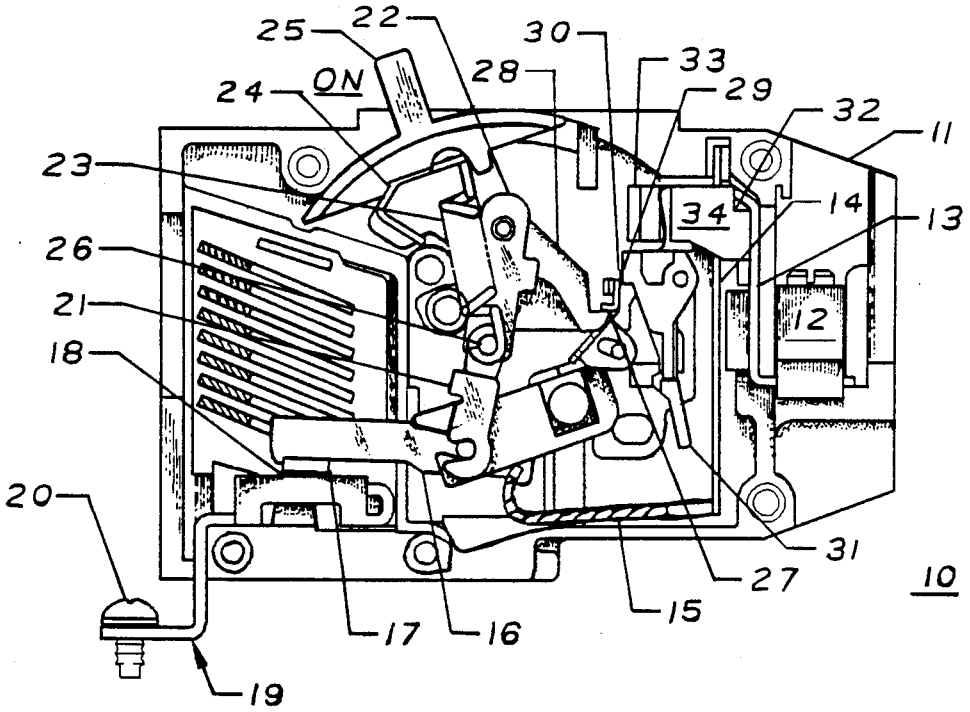
FIG. 1 is a side view of a circuit breaker employing the thermal magnetic trip unit, according to the invention.

A molded case circuit breaker 10 is shown in FIG. 1 consisting of a plastic case 11 to which electrical connection between a load and a movable contact arm 16 having a movable contact 17 attached thereto is made by means of a load terminal stud 12, load strap 13, thermal element or bimetal 14 and braid conductor 15. Electrical connection through the breaker is completed by means of a fixed contact 18 which connects with the line terminal screw 20 by means of a line strap 19. The movable contact arm 16 connects with an operating handle 25 by means of lower link 21, upper link 22, operating spring 23 and handle yoke 24. The upper and lower links are pivotally connected by means of a pivot pin 26 to which the operating spring 23 connects and which assists in moving the upper and lower links over center when the operating handle is in the ON position, as indicated. The contacts are held in a closed position against the bias provided by the stretched operating spring by the engagement between the hooked end of the cradle 28 with the bottom surface of the primary latch 27. A secondary latch 29 interferes with the back surface 30 of the primary latch to prevent the release of the hooked end of the cradle 28 from the primary latch. A magnetic trip unit 34, including an armature 33, is arranged around the bimetal 14 to control the tripping operation when overcurrent conditions occur.

Figure 2:
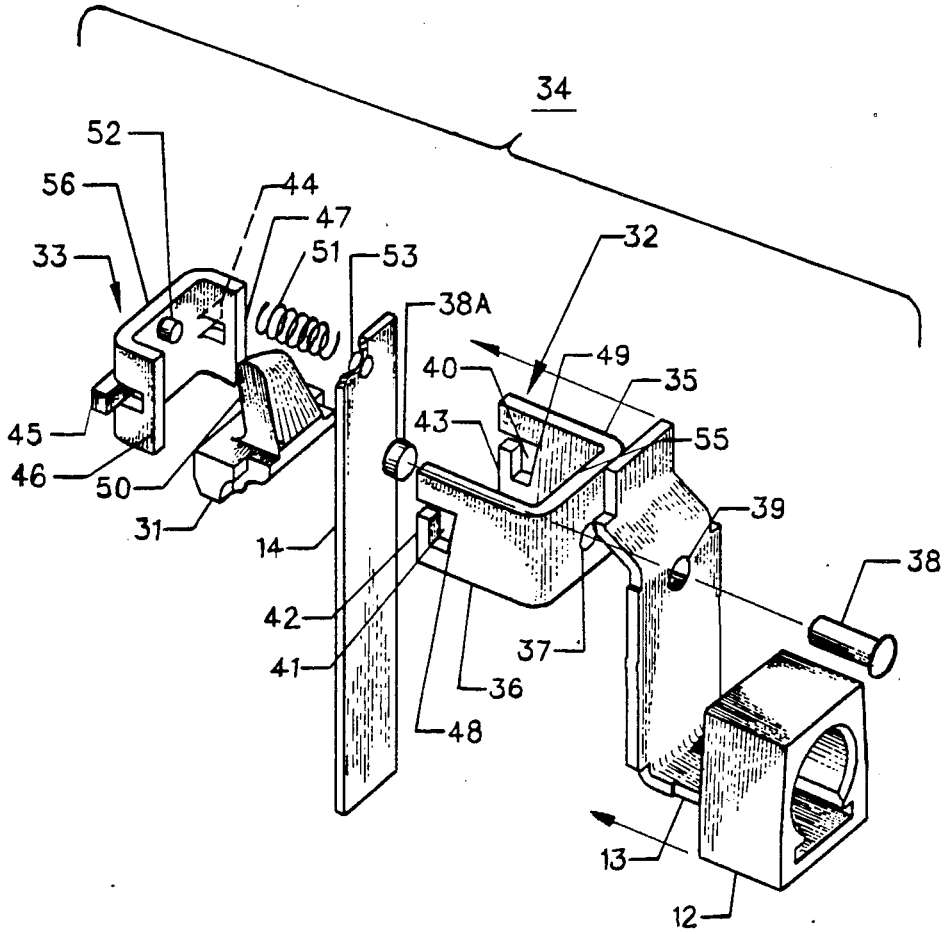
FIG. 2 is a top perspective view in isometric projection of the thermal magnetic trip unit of FIG. 1.
Figure 5:
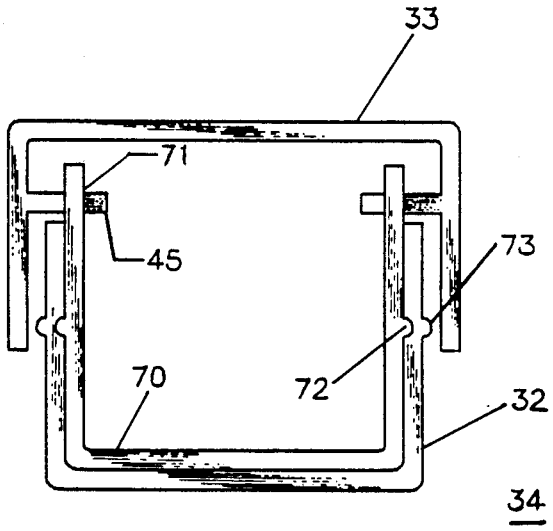
FIG. 5 is a top view of the magnetic trip unit of FIG. 4.

The magnetic trip unit 34 is shown in FIG. 2 with the magnet piece 32 formed from a single plate of magnetizable steel into a U-shaped configuration defined by a bight or plate 55 with a pair of perpendicular magnetic side arms 35 and 36. The magnet piece is attached to the load strap 13 by means of a screw or rivet 38 passing through a clearance hole 37 in the magnet backplate and into a corresponding hole 39 within the load strap. A spacer 38A is inserted between the load strap and the magnet piece to set the spacing, as will be discussed below in greater detail. The load strap is connected with the external electric circuit by means of the load terminal stud 12. When current transfers through the load strap an electromagnetic field is induced within the magnet piece and directed from the ends of the side arms in the indicated direction. The bimetal is attached to the top of the load strap by brazing or welding and extends parallel with the load strap for contacting a trip bar 31 to articulate the operating mechanism for opening the contacts when a threshold current value is exceeded. In some circuit breaker designs, the bimetal is replaced by a shaped memory element to obviate the thermal calibration requirements. The armature 33 is arranged at the top of the bimetal and load strap by placement of the tabs 44, 45 that are lanced from the armature side arms 46, 47 within corresponding triangular slots 40, 41 formed within the side arms 35, 36 of the magnet piece 32. A compression spring 51 is arranged between a stud 53 projecting from the top of the bimetal and a corresponding stud 52 projecting from a top portion of the armature plate 56 between the perpendicular armature side arms 46, 47. The armature spring 51 serves to set the air gap between the forward faces of the armature side arms and the forward faces of the side arms of the magnet piece. When a threshold value of current through the load strap is exceeded, the magnetic force generated within the magnet piece attracts the armature side arms away from support tabs 42, 43 against the ramp sides 48, 49 of the triangular slots 40, 41, bringing the armature plate 56 into contact with the top 50 of the trip bar to articulate the circuit breaker operating mechanism.

Figure 3A:
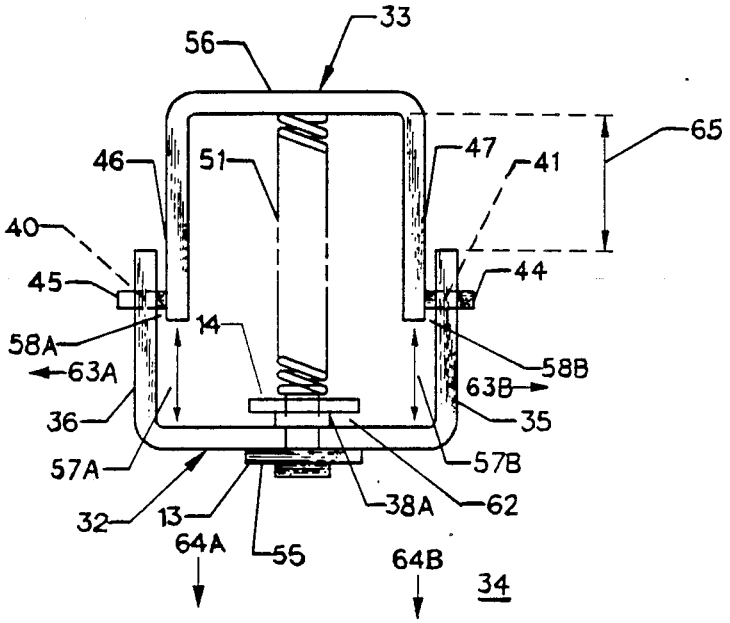
FIG. 3A is a top view of the magnet piece and armature used within the thermal magnetic trip unit of FIG. 2 with the armature internally overlapping the magnet piece.

The overlapping relationship between the side arms of the armature and the side arms of the magnet piece is best seen by referring now to FIG. 3A wherein a first pair of air gaps 57A, 57B is set between the front faces of the armature side arms 46, 47 and the plate 55 of the magnet piece and a second pair of air gaps 58A, 58B is set between the sides of the armature side arms 46, 47 and the sides of the magnet piece side arms 35, 36. The armature spring 51, arranged at the top of the bimetal 14 and the load strap 13, accurately sets the spacing of the air gaps 57A, 57B. The air gap 65 defined between the inner surface of the planar region of the armature and the front faces of the magnet side arms 35, 36 correlates to the prior art armature having no side arms. The spacer 38A sets the air gap 62 between the magnet piece plate 55 and the current carrying member such as the bimetal 14.

Figure 3B:
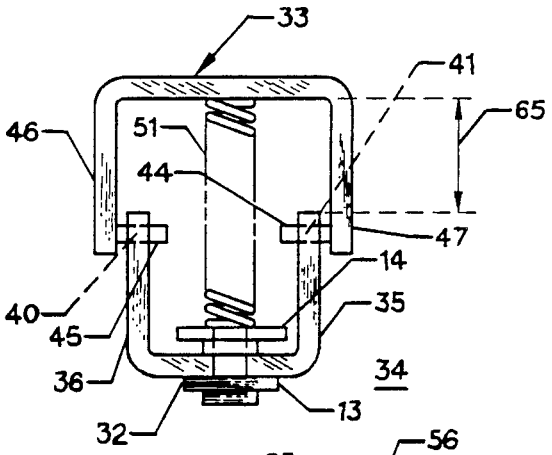
FIG. 3B is a top view of the magnet piece and armature used within the thermal magnet trip unit of FIG. 2 with the armature externally overlapping the magnet piece.

The arrangement of the armature side arms 46, 47 outboard of the magnet piece side arms 35, 36 is shown in FIG. 3B. The beneficial effect of overlap between the armature and magnetic side pieces is realized whether the armature side arms are inboard or outboard of the magnet piece side arms.

Figure 3C:
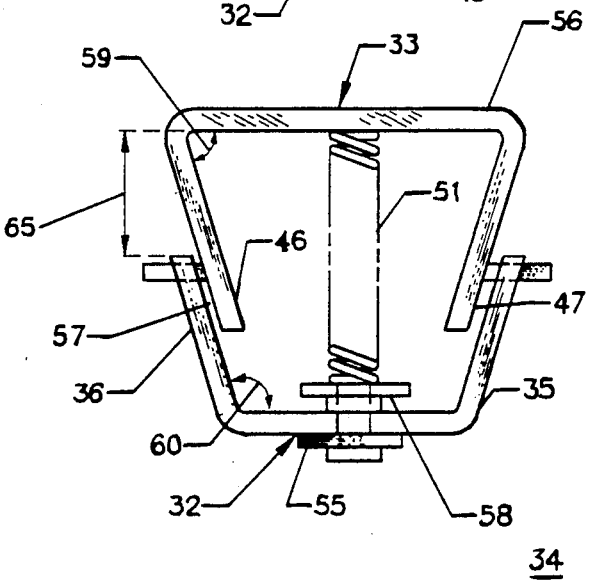
FIG. 3C is a top view of an alternate embodiment of the magnet piece and armature depicted in FIG. 2.

The arrangement of the magnetic trip unit 34, shown in FIG. 3C, contains a pair of armature side arms 46, 47 arranged at an angle 59 between the armature side arms and the armature plate of less than 90°, while the magnet piece side arms 35, 36 are arranged at an angle 60 between the magnet piece side arms and the magnet piece plate 55 at an angle greater than 90°.

Figure 4:
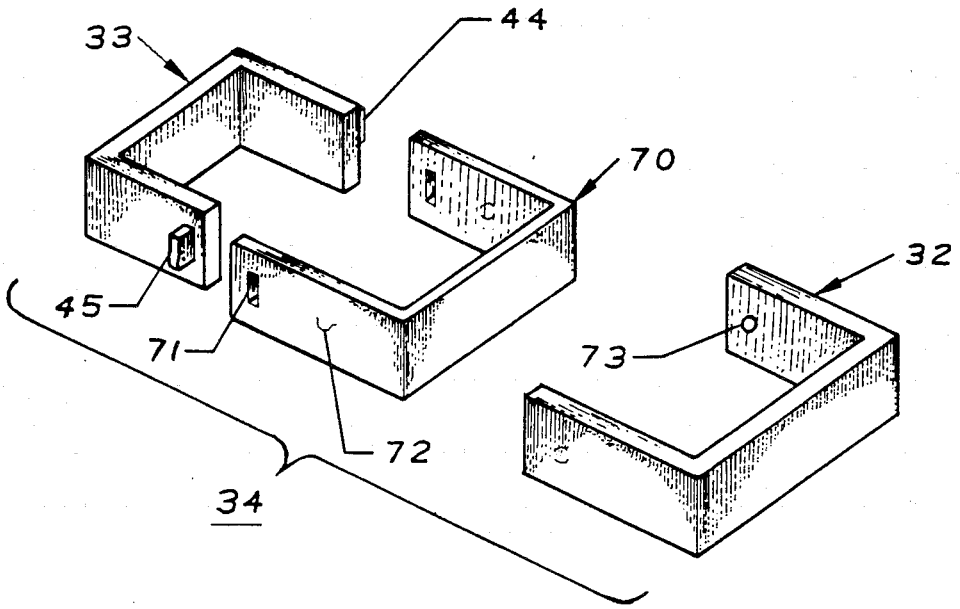
FIG. 4 is a top perspective view, in isometric projection, of a further embodiment of the magnetic trip unit of FIG. 2.

It has also been determined that the magnetic forces between the armature and the magnet pieces are enhanced by separately mounting the armature away from the magnet piece as compared to the convenient means of mounting the armature tabs within the triangular slots. A non-magnetic insert 70, made from brass or plastic, is inserted within the magnet 32 and held therein by means of detents 72 formed on the side arms of the insert and corresponding apertures 73 formed on the side arms of the magnet, as shown in FIG. 4. The support slots 71 formed on the side arms of the insert extend beyond the side arms of the magnet and receive the corresponding tabs 44, 45 formed on the side arms of the armature. The length of the insert side arms positions the spacing of the gap between the armature and the magnet, while the location of the detents 72 and the apertures 73 set the spacing between the bimetal 14 (FIG. 2) and the magnet.

Figure 6:
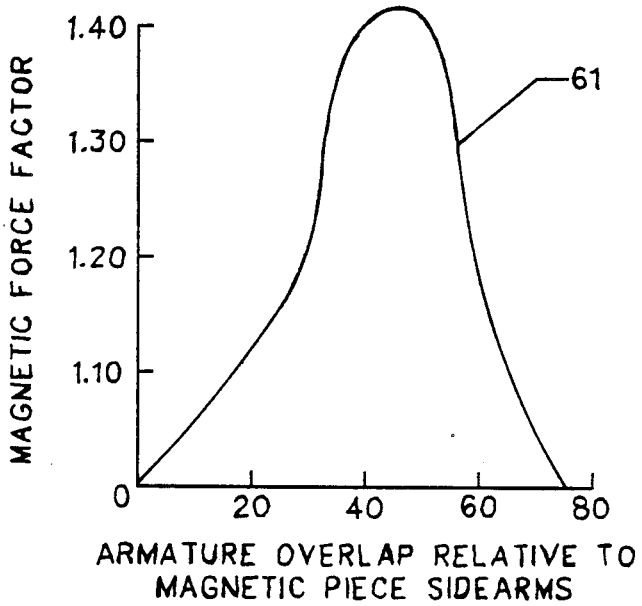
FIG. 6 is a graphic representation of the variation in magnetic force between the magnet piece and armature as a function of the length of the armature side arms; an FIG. 7 is a graphic representation of the relationship between magnetic force and separation distance between the load strap and the magnet piece.

The increased magnetic force exerted by the magnet piece on the armature is believed due to the increased length or "pole face" presented to the magnet piece by the overlapping armature side arms. This arrangement allows for a greater overlap without changing the overall geometric length of the magnetic trip unit 34. A comparison between an armature having an armature plate according to the prior art, wherein the length of the side arms is zero, can be seen by referring to FIG. 6 wherein the magnetic force on the armature is shown as a function of the length of the armature side arms, defined in percent of the armature side arm length to the magnet piece side arm length including the thickness of gap 65 as shown in FIGS. 3A–3C. It is noted that when the length of the armature side arms is increased beyond a certain percentage of the magnet piece side arms, the magnetic force on the armature begins to decrease. It is believed that when the armature side arms are increased beyond a certain defined length, the magnetic force of attraction between the magnet piece side arms and the armature side arms becomes mainly directed in the lateral direction as indicated by the lateral force vector arrows 63A, 63B in FIG. 3, rather than in the forward direction as indicated by the transverse force vector arrows 64A, 64B.

Any overlap between the armature side arms and the magnet piece side arms therefore increases the magnetic force of attraction up to an overlap of 75%. Further increase in overlap then may even cause the magnetic forces to oppose and prevent the armature from moving to the magnet piece, the optimum overlap being in the range of 40–60% as indicated.

Figure 7:
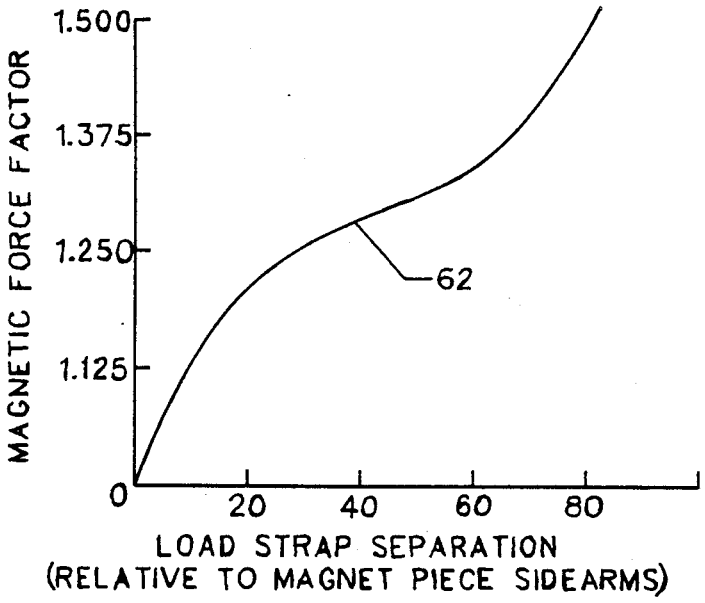

The effect of the magnetic attraction between the armature and the magnet piece can also be varied by adjusting the separation distance 62 between the magnet piece plate 55 and the bimetal 14, which can be seen by referring to both FIG. 3A and FIG. 7. The magnetic force profile 62 reflects the variation in the magnetic force on the armature at any separation distance between the magnet piece and the bimetal above zero gap separation distance wherein the bimetal is contiguous with the magnet piece. The separation distance is represented as the ratio of the separation distance to the length of the magnet piece side arms. It can be seen by comparing the magnetic force exerted by the magnetic piece on the armature as unity for a zero separation distance, when the magnet piece is directly attached to the bimetal without an intervening spacer, that the force increases with increasing separation distance.

It is thus shown that the magnetic trip force can be increased by providing an armature having extending side arms which overlap, in part, the side arms of a magnet piece encircling a current carrying member such as the bimetal or load strap within thermal magnetic trip units.

Having thus described our invention, what we claim as new and desire to secure by Letters Patent is:

1. A magnetic trip unit for molded case circuit breakers comprising:

a metal conductor electrically connected in series within an electric circuit;

a U-shaped magnet piece consisting of a first metal plate with a first pair of extending side arms encompassing a part of said metal conductor and inducing a magnetic force in a first direction upon transport of circuit current through said metal conductor; and a U-shaped armature in magnetic relation with said magnetic piece consisting of a second metal plate with a second pair of extending side arms, said first and second extending side arms being arranged in an overlapping relation, said armature being attracted to said magnet piece when said circuit exceeds a first threshold value, said armature side arms overlapping said magnet piece side arms from in excess of 1% of the length of said magnet piece side arms to less than 75% of said magnet piece side arms length.

2. The magnetic trip unit of claim 1 wherein said magnetic piece side arms are longer than said armature side arms.

3. The magnetic trip unit of claim 1 wherein said magnet piece side arms are arranged inboard of said armature side arms.

4. The magnetic trip unit of claim 1 wherein said armature side arms are arranged inboard of said magnet piece side arms.

5. The magnetic trip unit of claim 1 wherein said armature side arms are arranged a predetermined distance from said magnet piece side arms.

6. The magnetic trip unit of claim 1 wherein said magnet piece is arranged at a predetermined separation distance from said metal conductor to increase the magnetic force generated within said magnet piece.

7. The magnetic trip unit of claim 6 wherein said separation distance between said metal conductor and said magnet piece varies from in excess of 1% to less than 90% of the length of said magnet piece side arms.

8. The magnetic trip unit of claim 1 wherein said armature side arms overlap said magnet piece side arms from between 20 to 60% of said length of said magnet piece side arms.

9. The magnetic trip unit of claim 1 wherein said magnet piece side arms extend from said first metal plate at an angle less than 90°.

10. The magnetic trip unit of claim 1 wherein said armature side arms extend from said second metal plate at an angle in excess of 90°.

11. The magnetic trip unit of claim 1 wherein said magnetic piece side arms extend perpendicular from said first plate and said armature side arms extend perpendicular from said second plate.

12. The magnetic trip unit of claim 1 further including a spring interposed between said magnet piece and said armature to set the separation distance between said magnet piece side arms and said armature side arms.

13. The magnetic trip unit of claim 1 wherein said conductive metal strap comprises a thermally responsive element arranged for movement in a first direction when said circuit current exceeds a second threshold value.

14. The magnetic trip unit of claim 13 wherein said thermally responsive element comprises a bimetal or a shaped memory element.

15. The magnetic trip unit of claim 1 wherein said U-shaped magnet piece includes a tab extending from each of said armature side arms engaging a complementary slot formed within each of said magnet piece side arms.

16. The magnetic trip unit of claim 1 including a non-magnetic insert interposed between said magnet piece and said armature.

17. The magnetic trip unit of claim 16 wherein said non-magnetic insert comprises plastic or brass.

18. The magnetic trip unit of claim 16 wherein said insert includes a pair of detents arranged on opposite side arms formed on said insert and a pair of apertures formed within said magnet piece, said detents being retained within said apertures.

19. The magnetic trip unit of claim 16 wherein said insert is arranged within said magnet piece and pivotally supports said armature.

20. The magnetic trip unit of claim 16 wherein said insert is arranged within said armature and is pivotally supported by said magnet.

* * * * *